US008769724B2

(12) United States Patent
Semba et al.

(10) Patent No.: US 8,769,724 B2
(45) Date of Patent: Jul. 8, 2014

(54) GARMENT WITH CROTCH PART

(71) Applicant: Wacoal Corp., Kyoto (JP)

(72) Inventors: Takayuki Semba, Kyoto (JP); Tomoko Okamoto, Kyoto (JP)

(73) Assignee: Wacoal Corp., Kyoto-Shi (JP)

( * ) Notice: Subject to any disclaimer, the term of this patent is extended or adjusted under 35 U.S.C. 154(b) by 0 days.

(21) Appl. No.: 14/023,102

(22) Filed: Sep. 10, 2013

(65) Prior Publication Data

US 2014/0007320 A1 Jan. 9, 2014

Related U.S. Application Data

(63) Continuation of application No. 12/281,285, filed as application No. PCT/JP2007/052636 on Feb. 14, 2007, now abandoned.

(30) Foreign Application Priority Data

Mar. 16, 2006 (JP) ..... 2006-072916

(51) Int. Cl.

| | |
|---|---|
| ***A41D 1/06*** | (2006.01) |
| ***A41D 13/00*** | (2006.01) |
| ***A41D 1/08*** | (2006.01) |

(52) U.S. Cl.

CPC ..... *A41D 13/0015* (2013.01); *A41D 2600/10* (2013.01); *A41D 1/08* (2013.01); *A41D 2400/38* (2013.01); *A41D 2400/60* (2013.01)

USPC ..... 2/227; 2/69

(58) Field of Classification Search

CPC ..... A41D 1/08; A41D 1/082; A41D 1/084; A41D 1/086; A41D 2600/10; A41D 2300/22; A41B 11/003

USPC ..... 2/69, 227, 409, DIG. 1

See application file for complete search history.

(56) References Cited

U.S. PATENT DOCUMENTS

| | | | |
|---|---|---|---|
| 750,187 | A | 1/1904 | Gugenheim et al. |
| 4,089,064 | A | 5/1978 | Chandler, Jr. |

(Continued)

FOREIGN PATENT DOCUMENTS

| | | |
|---|---|---|
| JP | 4343868 | 11/1992 |
| JP | 2000-328305 | 11/2000 |

(Continued)

OTHER PUBLICATIONS

Office Action from Japanese Application No. 2006-072916 issued May 17, 2011.

(Continued)

*Primary Examiner* — Alissa L Hoey

(74) *Attorney, Agent, or Firm* — Leydig, Voit & Mayer, Ltd.

(57) ABSTRACT

A conditioning bottom 1 has a main body 2 and a strong tightening portion 3 which is in the form of a belt and has a tightening force stronger than a tightening force of the main body 2. This strong tightening portion 3 has first strong tightening portions 3*a* and a second strong tightening portion 3*b*. When the conditioning bottom 1 is worn, the first strong tightening portions 3*a* extend so as to surround gastrocnemius muscles of a wearer along outer edges of the gastrocnemius muscles, and the second strong tightening portion 3*b* is coupled to the first strong tightening portions 3*a* and extends through the inside of the wearer's lower leg and thigh to a position of the wearer's crotch. Also, a first mesh portion 4 having a tightening force weaker than the tightening force of the strong tightening portion 3 is formed in a section surrounded by the first strong tightening portions 3*a*.

5 Claims, 12 Drawing Sheets

(56) References Cited

U.S. PATENT DOCUMENTS

| | | | | |
|---|---|---|---|---|
| 4,625,336 | A | 12/1986 | Derderian | |
| 4,811,727 | A | 3/1989 | Etienne | |
| 4,946,453 | A | 8/1990 | Monson | |
| 5,263,923 | A | 11/1993 | Fujimoto | |
| 5,282,277 | A | 2/1994 | Onozawa | |
| 5,367,708 | A * | 11/1994 | Fujimoto | 2/22 |
| 5,640,714 | A | 6/1997 | Tanaka | |
| 5,737,773 | A | 4/1998 | Dicker et al. | |
| 5,745,917 | A | 5/1998 | Dicker et al. | |
| 5,857,947 | A * | 1/1999 | Dicker et al. | 482/124 |
| 6,098,198 | A | 8/2000 | Jacobs et al. | |
| 6,186,970 | B1 | 2/2001 | Fujii et al. | |
| 6,231,488 | B1 | 5/2001 | Dicker | |
| 6,243,879 | B1 | 6/2001 | Lyden | |
| 6,279,161 | B1 | 8/2001 | Johnston | |
| 6,332,221 | B1 | 12/2001 | Gracey | |
| 6,368,256 | B1 | 4/2002 | Rumbaugh | |
| 6,438,755 | B1 * | 8/2002 | MacDonald et al. | 2/69 |
| 6,446,264 | B2 | 9/2002 | Fairhurst et al. | |
| D505,770 | S | 6/2005 | Ota et al. | |
| D507,857 | S | 8/2005 | Ota et al. | |
| 7,117,537 | B2 | 10/2006 | Mazzarolo | |
| 7,229,390 | B2 | 6/2007 | Fujii et al. | |
| 7,516,498 | B2 | 4/2009 | Torry | |
| 7,631,367 | B2 | 12/2009 | Caillibotte et al. | |
| 7,814,576 | B2 | 10/2010 | Nakazawa | |
| 7,861,319 | B2 | 1/2011 | Torry | |
| 7,886,367 | B2 | 2/2011 | Chapuis et al. | |
| 2003/0028952 | A1 | 2/2003 | Fujii et al. | |
| 2003/0101506 | A1 | 6/2003 | Fujii et al. | |
| 2004/0025217 | A1 | 2/2004 | Mazzarolo | |
| 2004/0255358 | A1 | 12/2004 | Ota et al. | |
| 2005/0086721 | A1 | 4/2005 | Lambertz | |
| 2005/0193461 | A1 | 9/2005 | Caillibotte et al. | |
| 2005/0210559 | A1 | 9/2005 | Mazzarolo | |
| 2006/0026732 | A1 | 2/2006 | Nordt et al. | |
| 2006/0070164 | A1 | 4/2006 | Nordt et al. | |
| 2006/0169004 | A1 | 8/2006 | Belluye et al. | |
| 2008/0083055 | A1 | 4/2008 | Onda | |
| 2009/0025115 | A1 | 1/2009 | Duffy et al. | |
| 2009/0038047 | A1 | 2/2009 | Di Lorenzo | |

FOREIGN PATENT DOCUMENTS

| | | | |
|---|---|---|---|
| JP | 2001-192903 | A | 7/2001 |
| JP | 2002-212814 | A | 7/2002 |
| JP | 2003-532800 | A | 11/2003 |
| JP | 2004-137666 | A | 5/2004 |
| WO | WO 99/45802 | A1 | 9/1999 |

OTHER PUBLICATIONS

U.S. Appl. No. 12/281,285, filed Aug. 29, 2008.

* cited by examiner

GARMENT WITH CROTCH PART

CROSS REFERENCE TO PRIOR APPLICATIONS

This application is a continuation of U.S. application Ser. No. 12/281,285, filed on Aug. 29, 2008, which is the U.S. national phase application under 35 U.S.C. §371 of International Patent Application No. PCT/JP2007/052636, filed Feb. 14, 2007, and claims the benefit of Japanese Application No. 2006-072916, filed Mar. 16, 2006, each of which is incorporated by reference herein. The International Application was published in Japanese on Sep. 27, 2007 as International Publication No. WO 2007/108256 A1 under PCT Article 221(2).

TECHNICAL FIELD

The present invention relates to a garment with a crotch part, and particularly to a sports garment with a crotch part.

BACKGROUND ART

A lower leg supporter described in Patent Literature 1, for example, is known as a conventional garment with a crotch part. This lower leg supporter is constituted by a strong sheet piece that is made of a stretchable fabric having hard stretchability that is excellent in tightening force, and a weak sheet piece that is made of a stretchable fabric having soft stretchability. The lower leg supporter is applied such that the strong sheet piece passes thorough both sides of a wearer's gastrocnemius muscles and covers a wearer's soleus and a part of Achilles tendon.

Patent Literature 1: Japanese Patent No. 2603769

DISCLOSURE OF THE INVENTION

Problems to be Solved by the Invention

It is known that, for example, when performing exercise for a long time, venous return, which is a flow of blood returning from a vein to the heart, is enhanced by adding a moderate pressure to an appropriate part of a muscle. This venous return prevents the accumulation of fatigue substances and increases the stroke volume in accordance with the increase in the amount of blood returning to the heart, so that the load on the heart is reduced. As a result, fatigue resulted from the exercise can be alleviated, which allows comfortable exercise. However, the conventional garment with a crotch part described above cannot exert sufficient acceleration efficiency of venous return.

Therefore, an object of the present invention is to provide a garment with a crotch part for enhancing venous return.

Means for Solving the Problems

In order to achieve this object, a garment with a crotch part of the present invention is a garment with a crotch part for covering at least part of a lower body of a wearer. The garment of the crotch part includes: a main body having stretchability; a strong tightening portion having a tightening force stronger than a tightening force of the main body; and a weak tightening portion having a tightening force weaker than the tightening force of the strong tightening portion. The strong tightening portion has a first strong tightening portion and a second strong tightening portion. When the garment with a crotch part is worn, the strong tightening portion extends along outer edges of gastrocnemius muscles of a wearer so as to surround the gastrocnemius muscles, and the second strong tightening is coupled to the first strong tightening portion and extends along the wearer's muscles to a thigh of the wearer. The weak tightening portion can be formed in a section surrounded by the first strong tightening portion.

In this garment with a crotch part of the present invention, the first strong tightening portion with a strong tightening force extends along outer edges of the gastrocnemius muscles of the wearer so as to surround the gastrocnemius muscles. The gastrocnemius muscles are surrounded and pressed inward by the first strong tightening portions. In addition, the second strong tightening portion, which is coupled to the first strong tightening portion, extends along the wearer's muscles to a thigh of the wearer. The second strong tightening portion lifts the first strong tightening portion upward, effectively utilizing the tightening force of the second strong tightening portion and the muscles of the thigh. As a result, the gastrocnemius muscles of the wearer are, while being surrounded and pressed, strongly lifted upward or, in other words, in a direction in which the gastrocnemius muscles contract. Furthermore, the weak tightening portion having a tightening force weaker than the tightening force of the strong tightening portion is formed in a section which is surrounded by the first strong tightening portion and corresponds to the gastrocnemius muscles of the wearer. This weak tightening portion is easily stretched as the gastrocnemius muscles are contracted or relaxed due to the weak tightening force, and allows the gastrocnemius muscles to contract or relax easily. Therefore, wearing the garment with a crotch part of the present invention supports contractions and relaxations of the gastrocnemius muscles so that the muscle pumping effect on a calf can be promoted. This muscle pumping effect is the effect of circulating blood by allowing the muscles to contract and relax repeatedly such that the veins in the muscles are compressed by contracting the muscles and, on the other hand, that the veins become filled with blood by relaxing the muscles. Since blood stagnates in a calf, the muscle pumping effect particularly on the calf largely affects venous return in the calf, as it is known as the second heart. Therefore, the present invention can enhance venous return by promoting the muscle pumping effect on the calf.

The garment with a crotch part of the present invention may further have a first air-permeable portion having an air permeability higher than an air permeability of the main body, wherein the first air-permeable portion may be formed in at least part of a section corresponding to a calf of the wearer.

When, for example, the muscles are used and thereby heat is generated during exercise, the blood flow of the body surface increases in order to dissipate the heat. Therefore, by forming, as described above, the first air-permeable portion with good air permeability in at least part of a section corresponding to a calf that generates a large amount of heat, the generated heat amount can be dissipated suitably without causing an excessive increase in temperature or humidity. As a result, the blood flow of the body surface can be prevented from increasing or, in other words, a sufficient amount of blood flow can be secured in the veins running through the muscles, so that the muscle pumping effect can be achieved sufficiently.

If the first air-permeable portion is made with a mesh material, it is possible to effectively exert the abovementioned operation and effect that the generated heat amount can be dissipated suitably, a sufficient amount of blood flow can be secured in the veins running through the muscles, and the muscle pumping effect can be sufficiently achieved.

Moreover, the garment with a crotch part of the present invention may further have a second air-permeable portion having an air permeability higher than the air permeability of the main body. The second air-permeable portion may be formed in at least part of a section corresponding to the front side of the thigh of the wearer. By forming, as described above, the second air-permeable portion with good air permeability in at least part of a section corresponding to the front side of the thigh generating a large amount of heat, it is possible to dissipate the heat amount suitably, secure a sufficient amount of blood flow in the veins running through the muscles, and achieve the muscle pumping effect.

If the second air-permeable portion is made with a mesh material, it is possible to effectively exert the abovementioned operation and effect that the generated heat amount can be dissipated suitably, a sufficient amount of blood flow can be secured in the veins running through the muscles, and the muscle pumping effect can be sufficiently achieved.

Effects of the Invention

The present invention can provide a garment with a crotch part which can further enhance venous return.

EXPLANATION OF THE REFERENCE NUMERALS

Figure 1:
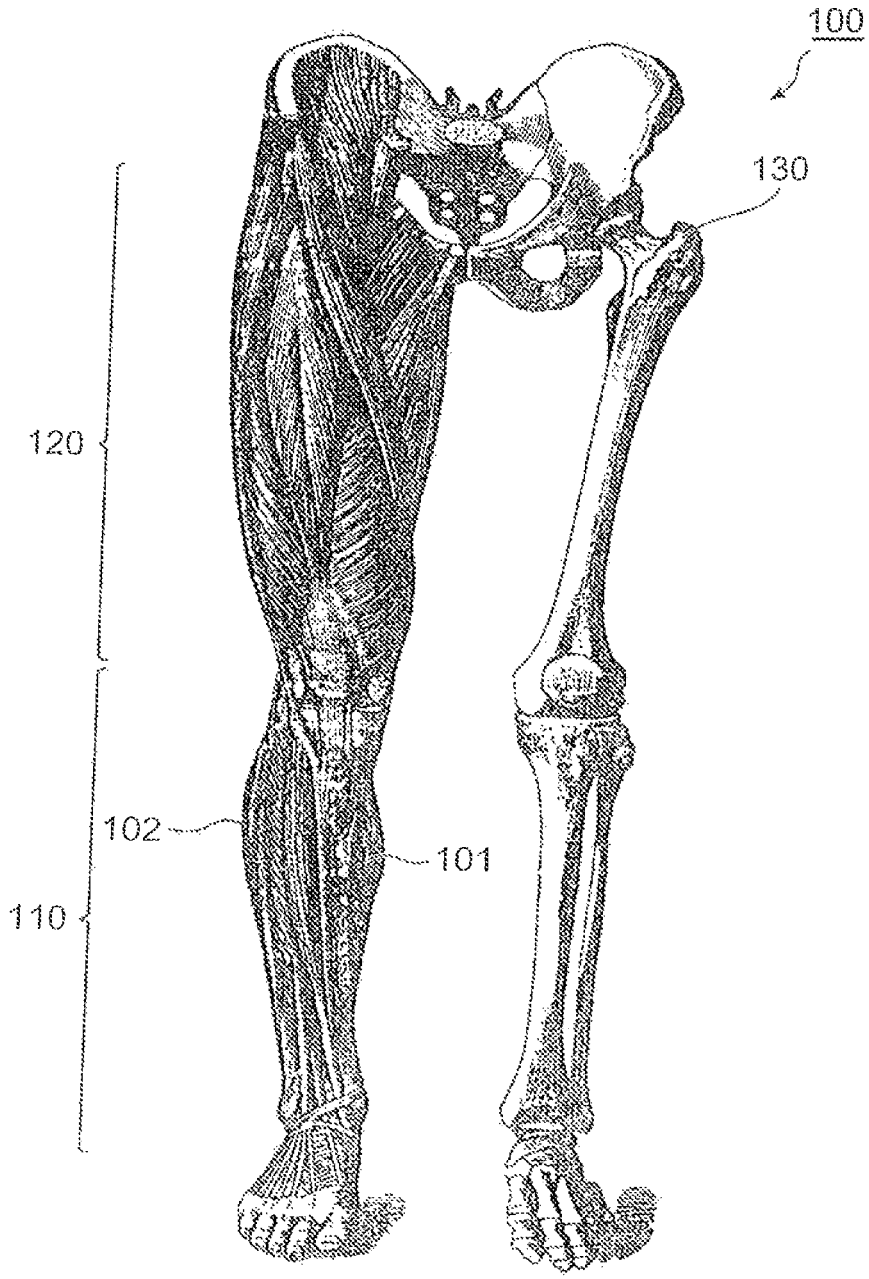
FIG. 1 is a front view of muscles and bones of lower limbs of a human body that are viewed from the front.

1, 10, 20: Conditioning bottom (garment with crotch part)
2: Main body
13, 23: Strong tightening portion
3*a*: First strong tightening portion
3*b*, 13*b*, 23*b*: Second strong tightening portion
4: First mesh portion (weak tightening portion, first air-permeable portion)
5: Second mesh portion (second air-permeable portion)
101: Gastrocnemius muscle
103: Calf
110: Lower leg
120: Thigh
130: Greater trochanter

BEST MODES FOR CARRYING OUT THE INVENTION

Hereinafter, preferred embodiments of the present invention will be described in detail with reference to the attached drawings. It should be noted that through the explanation of the drawings the same reference numerals are applied to the same elements, and overlapping explanation is omitted. It should also be noted that the terms such as "upper," "lower" and the like are used for descriptive purposes based on the conditions shown in the drawings.

Figure 2:
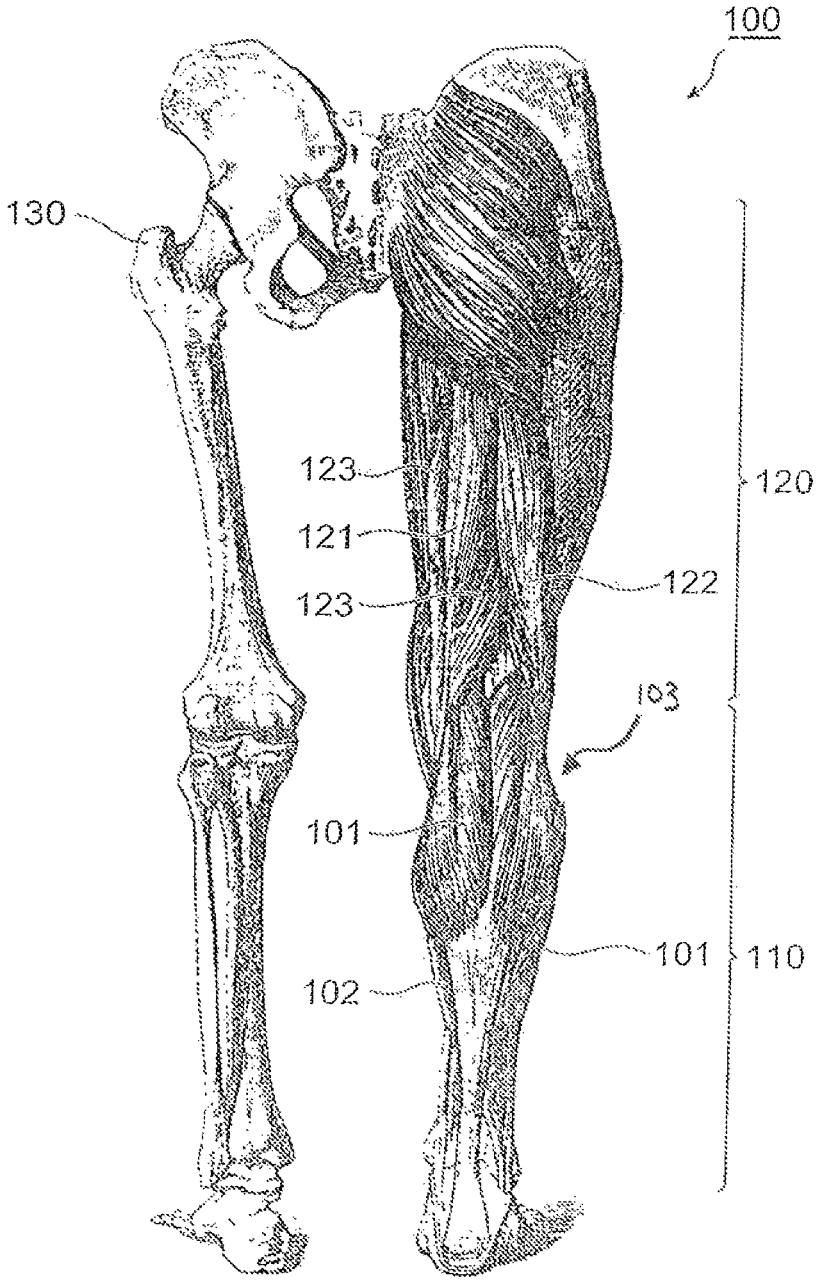
FIG. 2 is a front view of muscles and bones of the lower limbs of the human body that are viewed from the back.

First of all, prior to explaining the embodiments, arrangements of the muscles and bones will now be described with reference to FIG. 1 and FIG. 2 for explaining the functions of the present invention. FIG. 1 is a view of muscles and bones of lower limbs of a human body that are viewed from the front, and FIG. 2 is a view of muscles and bones of the lower limbs 100 of the human body that are viewed from the back. As shown in FIG. 1 and FIG. 2, gastrocnemius muscles 101 and soleus 102 are disposed in each of lower legs 110. The gastrocnemius muscles 101 and soleus 102 construct a calf 103. Furthermore, semitendinosus 121, biceps femoris 122 and semimembranosus 123 are arranged on the back of a thigh 120, and the semitendinosus 121, biceps femoris 122 and semimembranosus 123 are collectively called "hamstrings." The hamstrings functions so as to be involved in, for example, bending of the knee joint and extension of the hip joint. FIG. 1 and FIG. 2 also show a greater trochanter 130.

Figure 3:
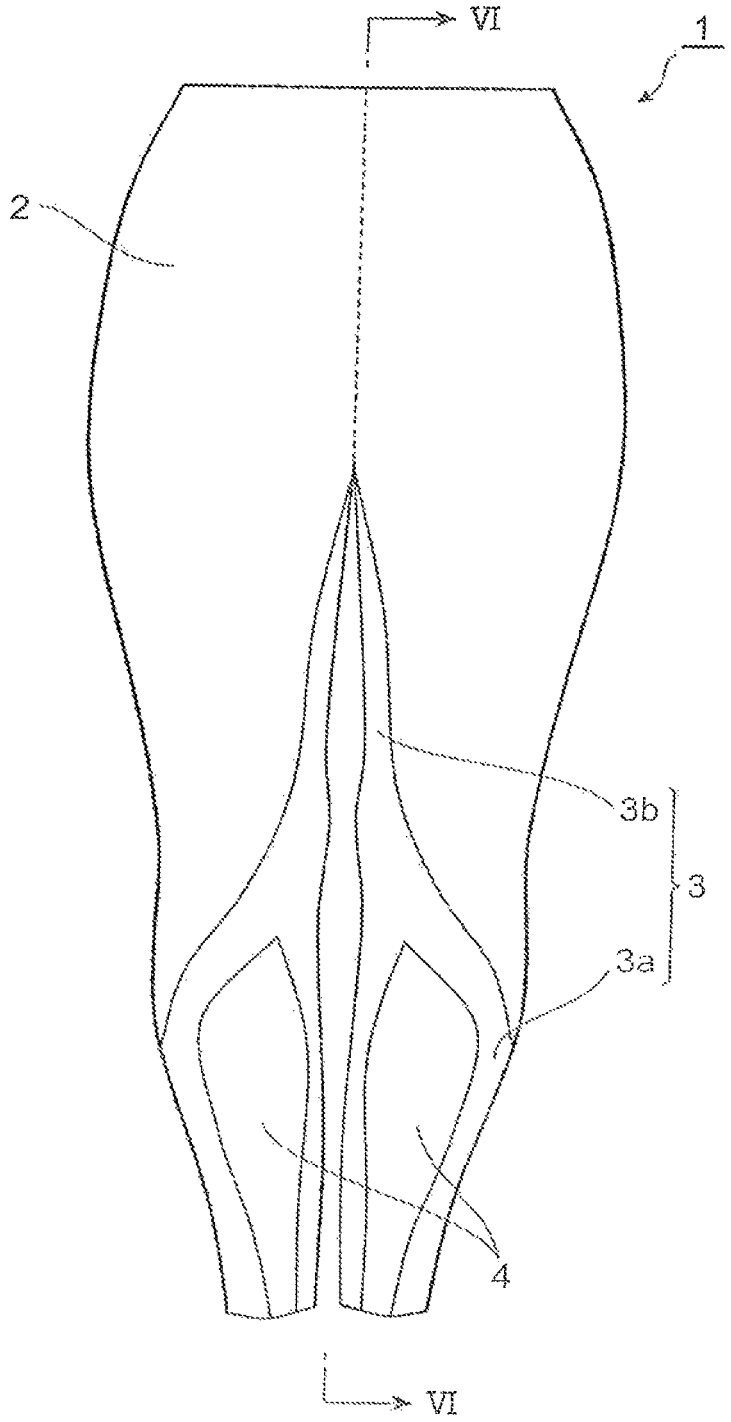
FIG. 3 is a back view showing a state in which a conditioning bottom according to a first embodiment of the present invention is worn.
Figure 4:
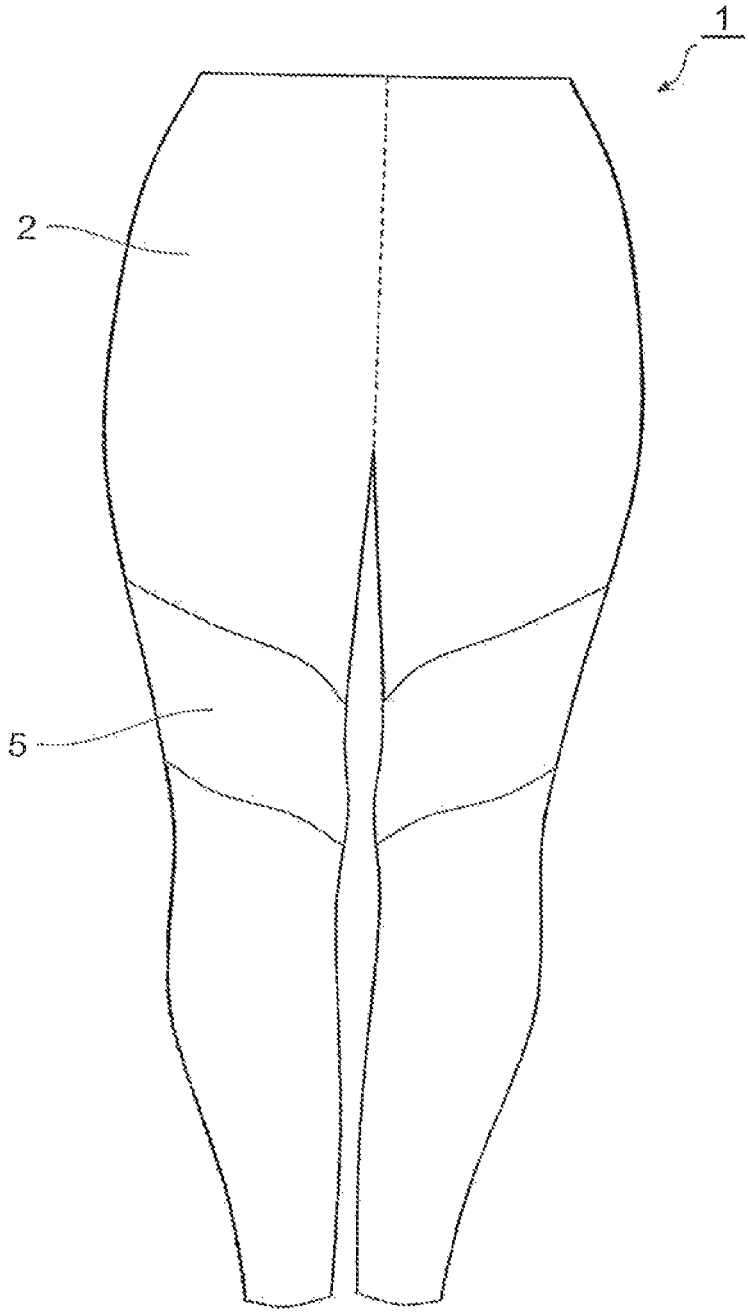
FIG. 4 is a front view showing the conditioning bottom of FIG. 3.
Figure 5:
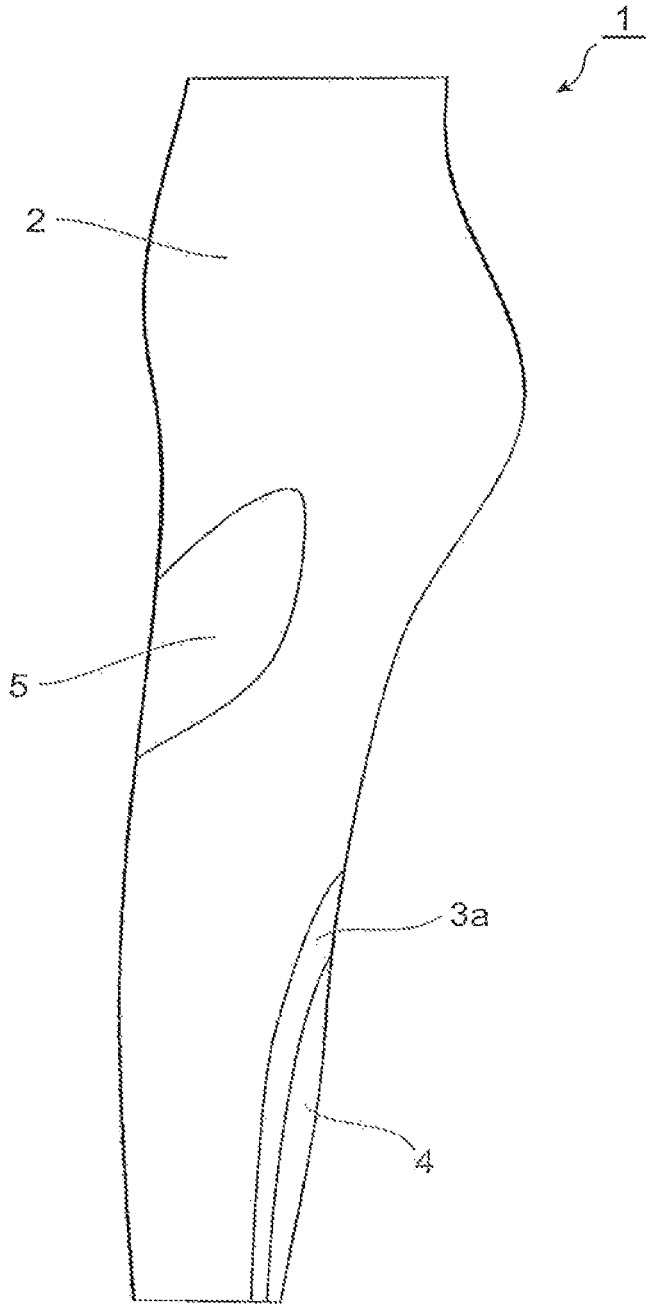
FIG. 5 is a side view showing the conditioning bottom of FIG. 3.
Figure 6:
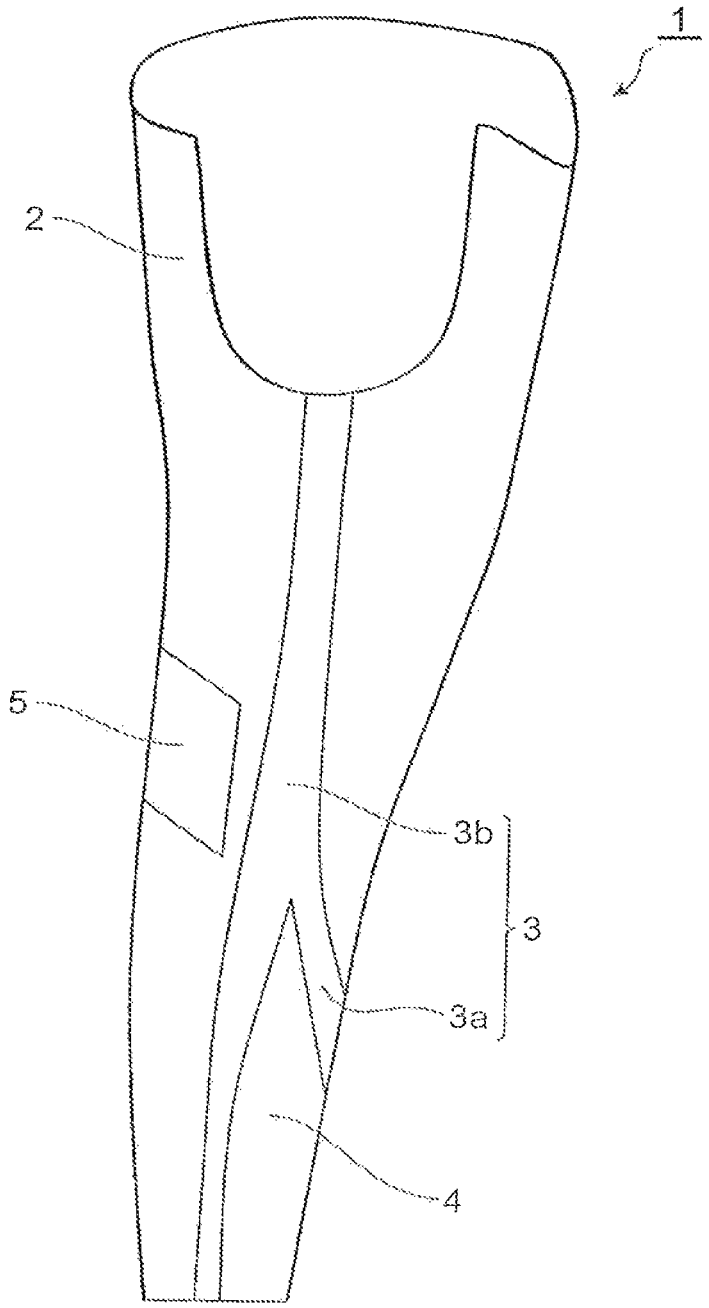
FIG. 6 is a cross-sectional view taken along the line VI-VI shown in FIG. 3.

Next, a conditioning bottom according to a first embodiment of the present invention will be described with reference to FIG. 3 to FIG. 6. FIG. 3 is a back view showing a state in which the conditioning bottom according to the first embodiment of the present invention is worn, FIG. 4 a front view showing the conditioning bottom of FIG. 3, FIG. 5 a side view showing the conditioning bottom of FIG. 3, and FIG. 6 a cross-sectional view taken along the line VI-VI shown in FIG. 3. In each of the drawings, the conditioning bottom 1 of the present embodiment is a sports garment in the shape of stockings, which is worn when, for example, playing sports and prevents the wearer's fatigue so that the wearer can play sports comfortably for a long time.

The conditioning bottom 1 has a main body 2 and a strong tightening portion 3. The main body 2 is in the shape of ankle-length stockings covering from a hip to the lower legs. This main body 2 is constituted by a knitted fabric with stretchability, and, for example, a stretchable two-way tricot knitted fabric, stretchable raschel knitted fabric, circular rib fabric, plain knitted fabric, or interlock knitted fabric is used as the knitted fabric with stretchability. It should be noted that the material of the main body 2 can be the one that can stretch in any two directions perpendicular to each other.

The strong tightening portion 3 has, in all directions thereof, a tightening force stronger than that of the main body 2, and is constituted by belt-like first strong tightening portions 3*a* and a belt-like second strong tightening portion 3*b* coupled to the first strong tightening portions 3*a*. The strong tightening portion 3 is configured by sewing stitching, sticking or adhering power nets to the main body 2. It should be noted that the strong tightening: portion 3 can be formed with a filler cloth or a dart. Alternatively, a section corresponding to the strong tightening portion 3 may be provided with a stronger tightening force by applying a bone or polyurethane resin thereto. A border between sections with different tightening forces has no difference in level so that the appearance is retained. The tightening forces described herein mean resistances of the corresponding materials to stretching. The stronger the tightening forces, the lower the stretchability of the materials is, and thus, as will be described hereinafter, when the conditioning bottom is worn, a larger pressure is applied to the section corresponding to the strong tightening portion 3 than to the other section so that the wearer's muscles in the strong tightening portion 3 are supported.

The first strong tightening portions 3*a* are formed in sections corresponding to the gastrocnemius muscles on the back of a lower leg of the wearer. More specifically, the first strong tightening portions 3*a* extend along outer edges of the gastrocnemius muscles from a lower end of the main body 2 and are coupled to each other in the vicinity of upper ends of the gastrocnemius muscles. In other words, the first strong tightening portion 3*a* on the inside of the calf of the lower leg of the main body 2 extends upward substantially perpendicularly from the lower end of the main body 2. The first strong tightening portion 3*a* on the outside of the calf of the lower leg of the main body 2 extends in the form of a curve (to protrude outward) so as to swell up, and these first strong tightening portions 3*a* are coupled to each other in the vicinity of the upper end of the calf (i.e., in the vicinity of a ham). Therefore, the first strong tightening portions 3*a* are formed so as to surround the gastrocnemius muscles of the wearer when the conditioning bottom is worn.

The second strong tightening portion 3*b* is coupled to the upper ends of the first strong tightening portions 3*a*. The second strong tightening portion 3*b* extends through the inside of the wearer's lower leg and thigh to a position of the crotch of the wearer when the conditioning bottom is worn. Specifically, the second strong tightening portion 3*b* extends from the upper ends of the first strong tightening portions 3*a* along the wearer's muscles to the wearer's thigh when the conditioning bottom is worn. In other words, the second strong tightening portion 3*b* is integrated with the inner first strong tightening portion 3*a* and extends upward substantially perpendicularly from the lower end of the main body 2 to the position of the crotch. Then, the outer first strong tightening portion 3*a* is integrated with the second strong tightening portion 3*b* extending vertically on the inside of the lower leg and thigh, so as to smoothly extend along the muscles in the vicinity of the upper end of the calf (i.e., in the vicinity of the ham). It should be noted that the right and left second strong tightening portions 3*b*, 3*b* are connected and coupled to each other at the position of the crotch.

The conditioning bottom 1 further has a first mesh portion 4 and second mesh portion 5 that are made of, for example, meshes formed with the above-described materials. These mesh portions 4, 5 are formed by being sewn, stitched, stuck or adhered to the main body 2. The first mesh portion 4 is formed in a section surrounded by the first strong tightening portions 3*a*. Specifically, the first mesh portion 4 is formed so as to substantially protrude outward in a section corresponding to the calf. The second mesh portion 5 is formed horizontally or, in other words, from the inside toward the outside in a knee section corresponding to the front side of the thigh so as to have a predetermined width. Specifically, the second mesh portion 5, having a width substantially equal to that of the thigh, is formed so as to extend obliquely upward from the inside to the outside of, for example, an above knee position when viewed from the front in a state where the conditioning bottom is worn, and an upper edge and lower edge of the second mesh portion 5 are shaped into curves. Also, the second mesh portion 5 is formed apart from the second strong tightening portion 3*b*. These mesh portions 4, 5 have tightening forces weaker than the tightening force of the strong tightening portion 3 in all directions thereof and have air permeability higher than that of the main body 2. Therefore, the first mesh portion 4 corresponds to the weak tightening portion and a first air-permeable portion, while the second mesh portion 5 corresponds to a second air-permeable portion. It should be noted that although the second mesh portion 5 is formed apart from the second strong tightening portion 3*b*, the second mesh portion 5 may be coupled to the second strong tightening portion 3*b*, and the mesh portions 4, 5 may have tightening forces weaker than the tightening force of the main body 2 in all directions thereof.

For example, when performing exercise for a long time wearing this conditioning bottom 1, the gastrocnemius muscles are surrounded and pressed inward by the first strong tightening portions 3*a* so that the calf is squeezed and supported. Moreover, since the second strong tightening portion 3*b* coupled to the first strong tightening portions 3*a* extends through the inside of the wearer's lower leg and thigh to the position of the crotch of the wearer, the first strong tightening portions 3*a* are strongly lifted upward by not only the tightening force of the second strong tightening portion 3*b* but also the muscles of the thigh or, particularly, contractions of the hamstrings. Specifically, the gastrocnemius muscles of the wearer are surrounded and pressed and at the same time lifted upward or, in other words, in a direction in which the gastrocnemius muscles contract. In addition, since the first mesh portion 4 is formed in the section surrounded by the first strong tightening portions 3*a*, this section is easily stretched as the gastrocnemius muscles are contracted or relaxed. Therefore, contractions and relaxations of the gastrocnemius muscles are supported so that the gastrocnemius muscles can contract and relax easily.

According to the conditioning bottom 1 described above, contractions and relaxations of the gastrocnemius muscles are supported so that the muscle pumping effect on the calf can be promoted. As a result, venous return, which is a flow of blood returning from a vein to the heart, can be enhanced.

Since the accumulation of fatigue substances such as lactic acid causes fatigue, improving the blood circulation and removing the fatigue substances can prevent fatigue resulted from exercise. Moreover, if the amount of blood returning to the heart is large, the stroke volume increases, and accordingly the load on the heart is reduced or, in other words, exercise can be performed comfortably. Therefore, in the present embodiment, decrease of the vital function can be prevented and the venous return can be enhanced by supporting the lower legs, so that fatigue resulted from the exercise can be alleviated, which allows comfortable exercise.

Also, the muscles on the inside of the thigh are not used much during, for example, exercise and therefore are less contracted or relaxed. Therefore, by extending the second strong tightening portion 3*b* over the inside of the thigh, the second strong tightening portion 3*b* can prevent it from disturbing the contraction and relaxation of the muscles upon exerting the function of lifting up the first strong tightening portions 3*a*. Therefore, the second strong tightening portion 3*b* can securely promote the muscle pumping effect in the calf and further enhance the venous return without reducing the muscle pumping effect.

Moreover, for example, when performing exercise in a hot environment or when the body temperature rises due to the heat generated by using muscles during exercise (that is, when the body becomes hot by performing exercise), the action is exerted which increases the blood flow of the body surface to dissipate heat to the outside to reduce the body temperature to a predetermined temperature. Therefore, when the body temperature increases, the blood flow in the veins running through the muscles decreases as the blood flow of the surface increases, and consequently the muscle pumping effect may be disturbed.

For this reason, the mesh-like air-permeable mesh portions 4, 5 is formed in the front side of the thigh and the calf, which are the parts where heat is generated most and thereby the temperature increases most when these muscles are used, to dissipate the heat and eliminate heat load from these parts or cool these parts, so that the increase of the body temperature or humidity can be prevented. Accordingly, a sufficient amount of blood flow can be secured in the veins running through the muscles, so that the muscle pumping effect can be achieved sufficiently and the decrease of the vital function can be prevented. As a result, so-called summer fatigue that is often caused when performing exercise during summer, such as increased heart rate, accumulation of fatigue substances, and fatigue due to heat, can be alleviated so that more comfortable exercise can be performed. Therefore, troublesome movements, such as cooling the body with water or wet towel and performing exercise in light clothing, can be avoided during exercise, fatigue due to heat can be prevented, and exercise can be performed readily and comfortably for a long time.

Next, a conditioning bottom according to a second embodiment of the present invention will now be described with reference to FIG. 7 and FIG. 8.

Figure 7:
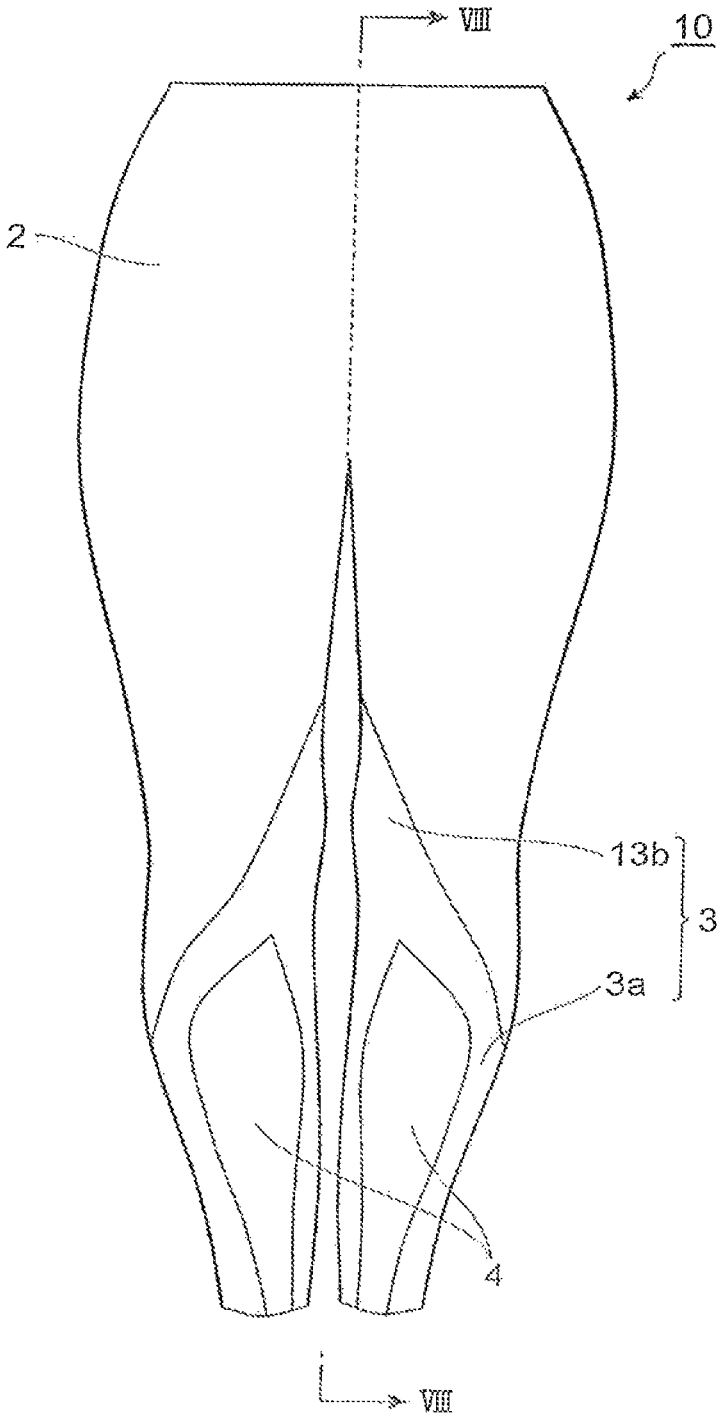
FIG. 7 is a back view showing a state in which a conditioning bottom according to a second embodiment of the present invention is worn.
Figure 8:
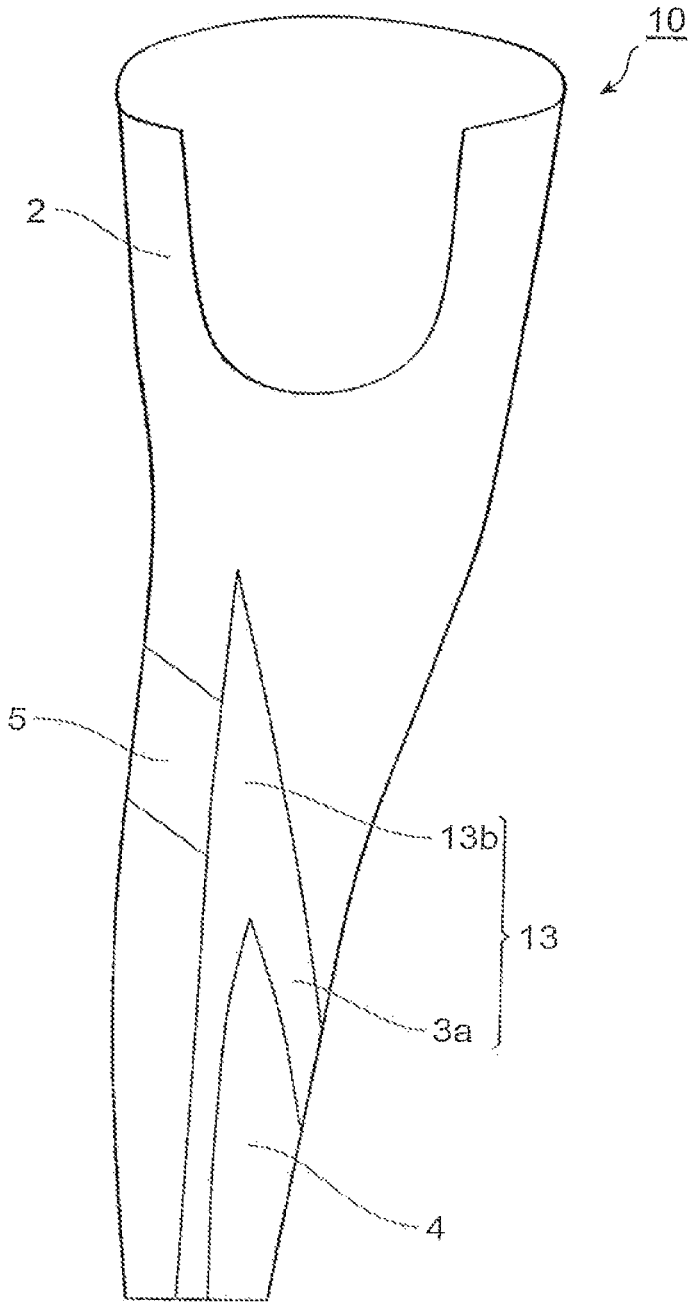
FIG. 8 is a cross-sectional view taken along the line VIII-VIII shown in FIG. 7.

FIG. 7 is a back view showing a state in which the conditioning bottom according to the second embodiment of the present invention is worn, and FIG. 8 is a cross-sectional view taken along the line shown in FIG. 7. The difference between the conditioning bottom 10 of the present embodiment and the conditioning bottom 1 of the first embodiment is that the conditioning bottom 10 is provided with a strong tightening portion 13 with a belt-like second strong tightening portion 13*b*, instead of the strong tightening portion 3 having the second strong tightening portion 3*b*.

This second strong tightening portion 13*b* has, in all directions thereof, a tightening force stronger than the tightening force of the main body 2 and is configured by, for example, sewing stitching, sticking or adhering power nets to the main body 2. It should be noted that a filler cloth or a dart may be used for forming the second strong tightening portion 13*b*. In addition, the second strong tightening portion 13*b* may be provided with a stronger tightening force by applying a bone or polyurethane resin thereto.

The second strong tightening portion 13*b* is coupled to the upper ends of the first strong tightening portions 3*a* and extends so as to run through the inside of the lower leg and the thigh of the wearer to the vicinity of the center of the inside of the thigh, when the conditioning bottom 10 is worn. Specifically, the second strong tightening portion 13*b* extends along the wearer's muscles from the upper ends of the first strong tightening portions 3*a* up to the thigh, when the conditioning bottom 10 is worn. In other words, the second strong tightening portion 13*b* is integrated with the inner first strong tightening portion 3*a* and extends upward substantially perpendicularly from the lower end of the main body 2 up to the position in the vicinity of the center on the inside of the thigh or, in other words, to the position before the position of the crotch. Then, the outer first strong tightening portion 3*a* is integrated with the second strong tightening portion 13*b* extending vertically on the inside of the lower leg and thigh, so as to smoothly extend along the muscles in the vicinity of the upper end of the calf (i.e., in the vicinity of the ham). The second strong tightening portion 13*b* is further formed so as to be coupled to the second mesh portion 5 at an inner end portion of the second mesh portion 5.

When this conditioning bottom 10 too is worn, since the second strong tightening portion 13*b* coupled to the first strong tightening portions 3*a* extends through the inside of the wearer's lower leg and thigh to the vicinity of the center of the inside of the thigh, the first strong tightening portions 3*a* are strongly lifted upward by not only the tightening force of the second strong tightening portion 13*b* but also contractions of the muscles of the thigh. Specifically, the gastrocnemius muscles of the wearer are lifted upward while being surrounded and pressed. Therefore, contractions and relaxations of the gastrocnemius muscles are supported, and the effect same as the effect of the first embodiment can be achieved, that is, the effect of promoting the muscle pumping effect on the calf. As a result, the venous return, which is a flow of blood returning from a vein to the heart, can be enhanced.

It should be noted that although the second strong tightening portion 13*b* is formed so as to be coupled to the second mesh portion 5, the second strong tightening portion 13*b* may be formed apart from the second mesh portion 5.

Next, a conditioning bottom according to a third example of the present invention will now be described with reference to FIG. 9 to FIG. 12.

Figure 9:
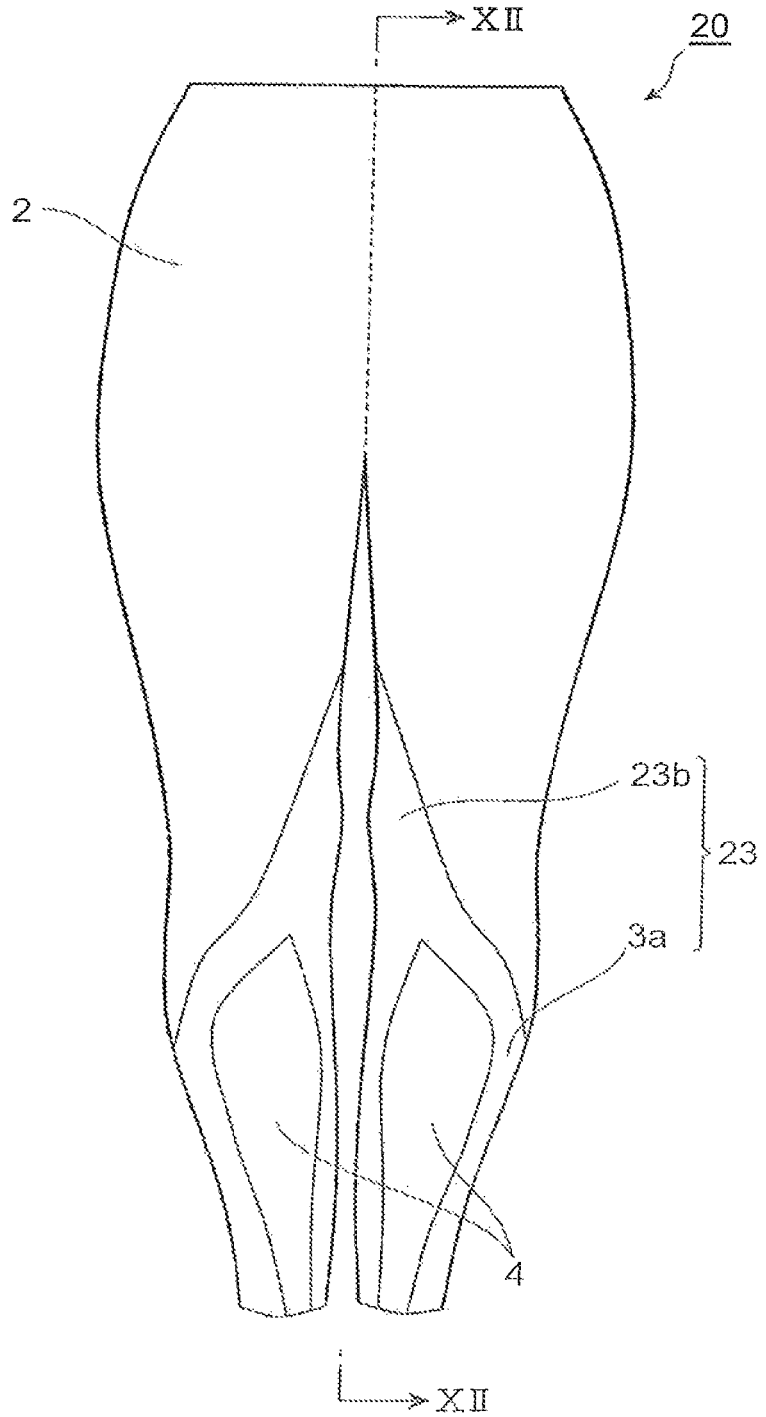
FIG. 9 is a back view showing a state in which a conditioning bottom according to a third embodiment of the present invention is worn.
Figure 10:
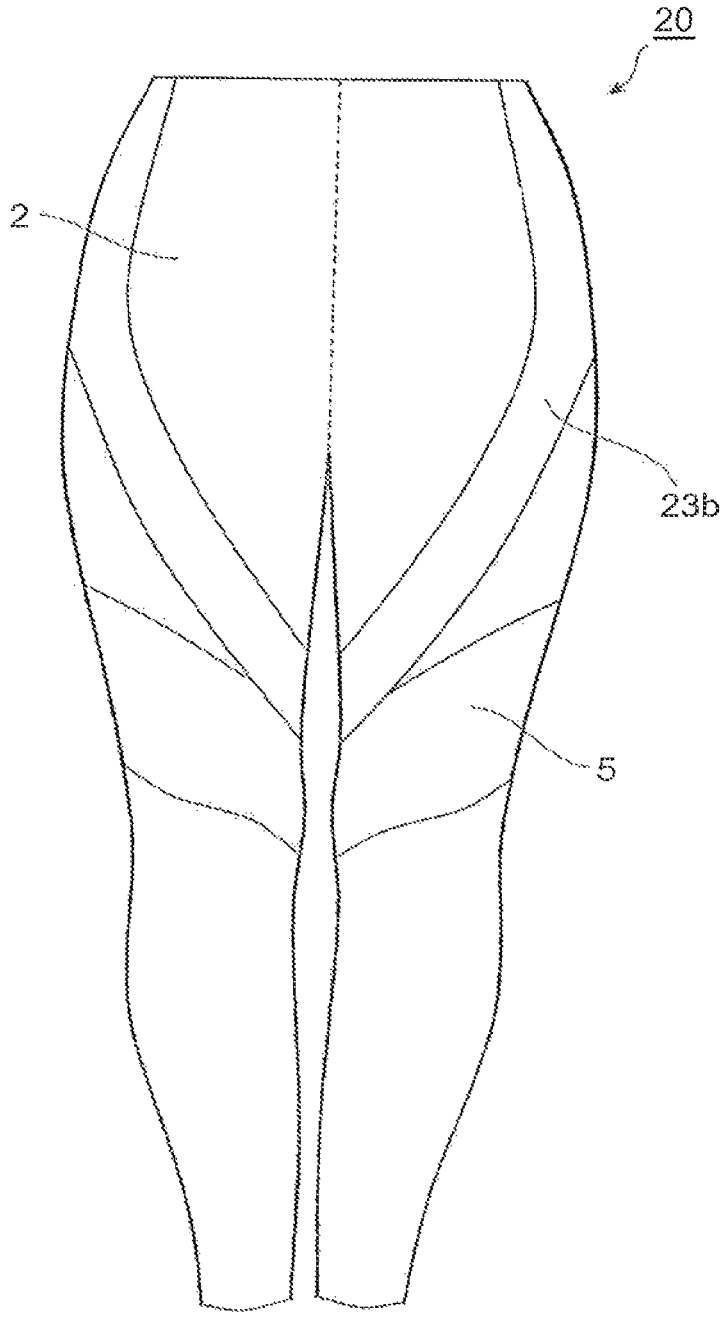
FIG. 10 is a front view showing the conditioning bottom of FIG. 9.
Figure 11:
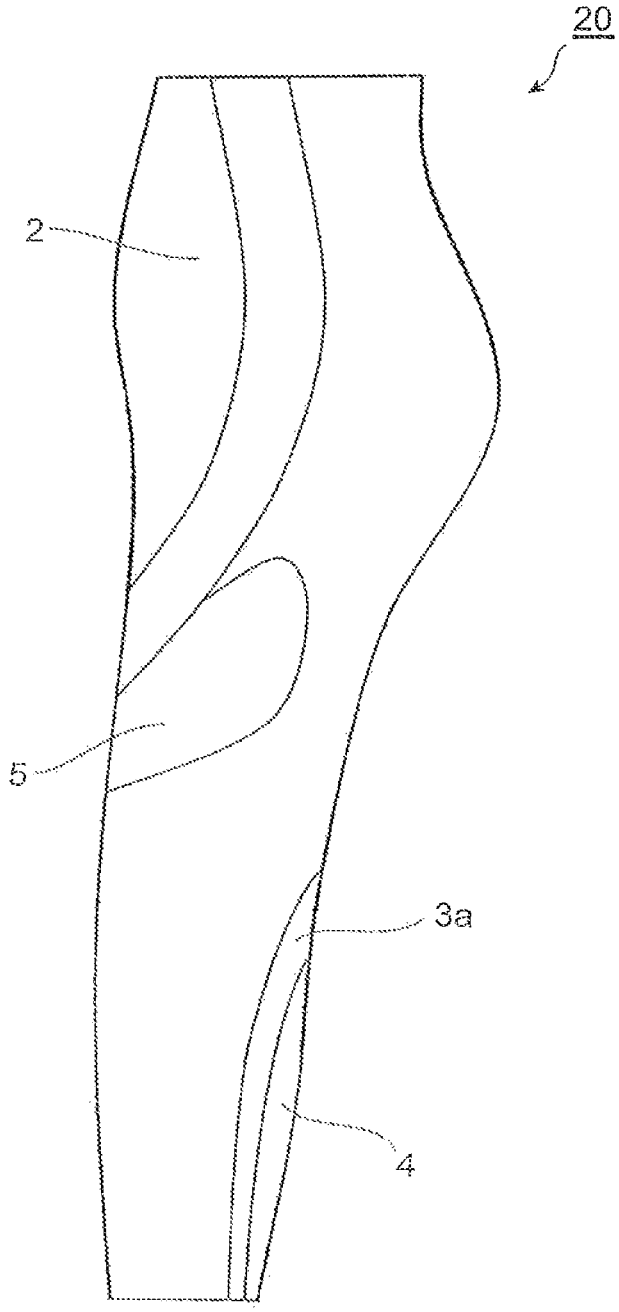
FIG. 11 is a side view showing the conditioning bottom of FIG. 9.
Figure 12:
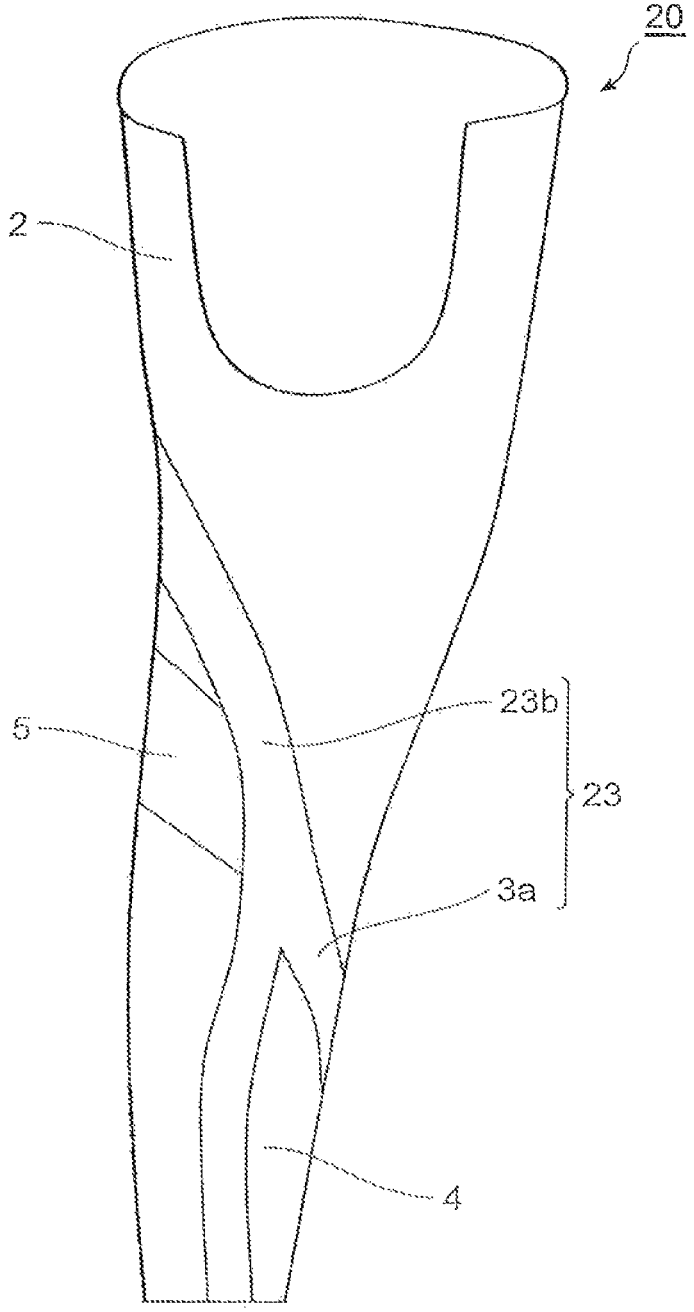
FIG. 12 is a cross-sectional view taken along the line XII-XII shown in FIG. 9.

FIG. 9 is a back view showing a state in which the conditioning bottom according to the third embodiment of the present invention is worn, FIG. 10 a front view showing the conditioning bottom of FIG. 9, FIG. 11 a side view showing the conditioning bottom of FIG. 9, and FIG. 12 a cross-sectional view taken along the line XII-XII shown in FIG. 9. The difference between the conditioning bottom 20 of the present embodiment and the conditioning bottom 1 of the first embodiment is that the conditioning bottom 20 is provided with a strong tightening portion 23 with a belt-like second strong tightening portion 23*b*, instead of the strong tightening portion 3 having the second strong tightening portion 3*b*.

As with the second strong tightening portion described above, the second strong tightening portion 23*b* has, in all directions thereof, a tightening force stronger than the tightening force of the main body 2 and is configured by, for example, sewing, stitching, sticking or adhering power nets to the main body 2. It should be noted that a filler cloth or a dart may be used for forming the second strong tightening portion 13*b*. In addition, the second strong tightening portion 13*b* may be provided with a stronger tightening force by applying a bone or polyurethane resin thereto.

The second strong tightening portion 23*b* is coupled to the upper ends of the first strong tightening portions 3*a*, and extends so as to run through the inside of the lower leg of the wearer to the vicinity of the center of the inside of the thigh, when the conditioning bottom 20 is worn. In other words, the second strong tightening portion 23 is integrated with the inner first strong tightening portion 3*a* and extends upward substantially perpendicularly from the lower end of the main body 2 up to the position in the vicinity of the center on the inside of the thigh or, in other words, to the position before the position of the crotch. In addition, the outer first strong tightening portion 3*a* is integrated with the second strong tightening portion 23*b* extending vertically on the inside of the lower leg and thigh, so as to smoothly extend along the muscles in the vicinity of the upper end of the calf (i.e., in the vicinity of the ham).

Then, in the vicinity of the center on the inside of the thigh, the second strong tightening portion 23*b* extends from the vicinity of the center to the vicinity of an inner position on the front side of the thigh (an upper end inner position of the second mesh portion 5) so as to extend along the thigh. In other words, when the conditioning bottom 20 is worn, the second strong tightening portion 23*b* on the inside of the thigh extends obliquely upward to from the rear side of the thigh to the front side of the thigh through the inside of the thigh, so as to couple the second strong tightening portion 23*b* on the rear side to the second strong tightening portion 23*b* on the front side. Then, on the front side of the thigh, the second strong tightening portion 23*b* extends obliquely from the vicinity of the inner position (the upper end inner position of the second mesh portion 5) to the vicinity of an outer position on the hip side. Specifically, when the conditioning bottom 20 is worn, the second strong tightening portion 23*b* runs through the inside of the lower leg of the wearer and extends obliquely from an inner part of the knee joint to the vicinity of the greater trochanter. The second strong tightening portion 23*b* then extends vertically and substantially perpendicularly from the greater trochanter to the upper end of the main body 2 along the side of the hip. Therefore, when the conditioning bottom 20 is worn, the second strong tightening portion 23*b* extends from the upper ends of the first strong tightening portions 3*a* to the wearer's thigh along the wearer's muscles. The second strong tightening portion 23*b* is further formed so as to be coupled to the second mesh portion 5 at the inner end portion of the second mesh portion 5 and the inside portion of the upper end of the second mesh portion 5.

When this conditioning bottom 20 too is worn, the second strong tightening portion 23*b* strongly lifts the first strong tightening portions 3*a* upward by using not only the tightening force of the second strong tightening portion 23*b* but also contractions of the muscles of the thigh. Specifically, the gastrocnemius muscles of the wearer are lifted upward while being surrounded and pressed. Therefore, contractions and relaxations of the gastrocnemius muscles are supported, and the effect same as the effect of the first embodiment can be achieved, that is, the effect of promoting the muscle pumping effect on the calf. As a result, the venous return, which is a flow of blood returning from a vein to the heart, can be enhanced.

It should be noted that although the second strong tightening portion 23*b* extends obliquely from a section corresponding to the inside of the knee joint through the inside of the wearer's lower leg, it may extend obliquely from a section corresponding to the outside of the knee joint through the outside of the wearer's lower leg. In this case, the right and left second strong tightening portions are coupled to each other at a position above the wearer's crotch.

In addition, although the second strong tightening portion 23*b* is formed so as to be coupled to the second mesh portion 5, the second strong tightening portion 23*b* may be formed apart from the second mesh portion 5.

The conditioning bottom 1 descried above and a conventional conditioning bottom were put on five human subjects (trialists) to compare average values of nude ratios of the total hemoglobin content, which is a venousreturn, under environmental conditions of a temperature of 25° C. and humidity of 50%. As a result, the average value was 1.0 when the conventional conditioning bottom was worn, while it was 1.6 when the conditioning bottom 1 was worn, which means that the effect of further enhancing the venous return was confirmed. It should be noted that nude ratio represents the ratio between the value obtained when the garment is not worn and the value obtained when the garment is worn, and the nude ratio described herein represents the total hemoglobin content in a state where the conditioning bottoms were worn, on the basis of the total hemoglobin content obtained in a state where nothing is put on the sections between knees and ankles.

Furthermore, the conditioning bottom 1 and the conventional conditioning bottom were put on a male subject to compare average values of stroke volumes obtained when an ergometer was used for 60 minutes under load conditions of 33° C. and 65%. The ergometer was used for 60 minutes with four sets of 15-minute exercises+5-minute break. As a result, the maximum stroke volume was 106 ml and the minimum stroke volume was 69 ml when the conventional conditioning bottom was worn, while the maximum stroke volume was 116 ml and the minimum stroke volume was 79 ml when the conditioning bottom 1 was worn, which means that the effects of further enhancing the venous return and increasing the stroke volume were confirmed. Moreover, esophageal temperatures were compared in this test, and when the conventional conditioning bottom was worn, the esophageal temperature was 36.9° C., while it was 36.6° C. when the conditioning bottom 1 was worn, which means the effect of preventing the increase of the body temperature during exercise was also confirmed.

The preferred embodiments of the present invention has been described above, but the present invention is not limited to the above embodiments.

For example, although the mesh portions 4, 5 are in the form of meshes, they may be formed any fabric as long as they have air permeability higher than that of the main body 2. Also, the second mesh portion may be formed in at least part of a section corresponding to the front side of a thigh, and similarly at least part of a section corresponding to a calf of a wearer may have the air permeability of the first mesh portion. Furthermore, when, for example, the increase of the body temperature is not necessarily considered, the air permeability of the first mesh portion may be equal to the air permeability of the main body 2 and the second mesh portion may not be formed.

Moreover, in the above embodiments the second mesh portion 5 and the first mesh portion 4 are made of the same material for the reason of manufactural convenience and the like. Therefore, the second mesh portion 5 also has a tightening force weaker than the tightening force of the strong tightening portion 3, but the tightening force of the second mesh portion may be, of course, equal to the tightening force of the main body 2 or strong tightening portion 3.

In addition, although the right and left second strong tightening portions 3*b*, 3*b* are connected and coupled to each other at the position corresponding to the crotch in the first embodiment described above, the right and left second strong tightening portions may not be coupled to each other.

Moreover, the tightening forces of the strong tightening portions 3, 13, 23 and of the first mesh portion 4 serving as the weak tightening portion may be changed by using a power-switching with, for example, warp knit or circular knit (weft knitting) as the knit structure of the knitted fabric (so-called knitting manner). Specifically, a desired tightening force may be provided by adopting an appropriate type of knitted fabric, type, number and thickness of yarns to be inserted for the knit structure.

INDUSTRIAL APPLICABILITY

The present invention can provide a garment with a crotch part which further enhances venous return by promoting the muscle pumping effect on a calf of a wearer.

The invention claimed is:

1. A garment with a crotch part for covering at least part of a lower body of a wearer, the garment having two leg portions coupled together, comprising:

a main body having stretchability;

a first tightening portion (3) having a tightening force stronger than a tightening force of the main body, the stronger tightening force having lower stretchability; and a second tightening portion (4) having a tightening force weaker than the tightening force of the first tightening portion, the weaker tightening force having greater stretchability, wherein the first tightening portion (3) is formed such that a primary first tightening portion (3*a*) provided at a back side of a lower leg portion of the garment and a secondary first tightening portion (3*b*) provided at an inner side of a thigh portion of the garment are coupled to each other at an inner side of a back of a knee portion of the garment, the primary first tightening portion (3*a*) of the first tightening portion includes an inner portion linearly extending upward along an inner side of the lower leg portion from a vicinity of an inner side of an ankle portion to the inner side of the back of the knee portion and an outer portion extending from a vicinity of an outer side of the ankle portion to an upper calf portion of the garment along an outer edge of the calf portion that curves to protrude outward and extending obliquely on the upper calf portion to the inner side of the back of the knee portion, the secondary first tightening portion (3*b*) of the first tightening portion extends continuously upward along an inner side of a leg portion from the inner side of the back of the knee portion beyond the inner side of the thigh portion to a crotch portion where the leg portions are coupled together, and the second tightening portion is formed in a section for covering the calf portion surrounded by the primary first tightening portion (3*a*) of the first strong tightening portion.

2. The garment with a crotch part according to claim 1, further comprising an air-permeable portion having an air permeability higher than an air permeability of the main body, wherein the air-permeable portion is formed in at least part of a section of the calf portion.

3. The garment with a crotch part according to claim 2, wherein the air permeable portion is made with a mesh material.

4. The garment with a crotch part according to claim 1, further comprising an air permeable portion having an air permeability higher than the air permeability of the main body, wherein the air permeable portion is formed in at least part of a section of a front side of the thigh portion.

5. The garment with a crotch part according to claim 4, wherein the air permeable portion is made with a mesh material.

* * * * *